US006932531B2

(12) United States Patent
Marschand et al.

(10) Patent No.: US 6,932,531 B2
(45) Date of Patent: Aug. 23, 2005

(54) WRITING ASSEMBLY WITH ERASER ASSEMBLY

(75) Inventors: Bret R. Marschand, Oak Park, IL (US); Neville E. Andrews, Naperville, IL (US)

(73) Assignee: Sanford L.P., Freeport, IL (US)

( * ) Notice: Subject to any disclaimer, the term of this patent is extended or adjusted under 35 U.S.C. 154(b) by 0 days.

(21) Appl. No.: 10/424,411

(22) Filed: Apr. 28, 2003

(65) Prior Publication Data

US 2004/0213627 A1 Oct. 28, 2004

(51) Int. Cl.[7] ..... B43K 5/00; B43K 29/00
(52) U.S. Cl. ..... 401/202; 401/195
(58) Field of Search ..... 401/52, 195, 202, 401/247; 15/425–428, 431, 432

(56) References Cited

U.S. PATENT DOCUMENTS

| | | | | |
|---|---|---|---|---|
| 1,822,166 A | | 9/1931 | Most | |
| 1,925,388 A | | 9/1933 | Hutter | |
| 1,998,684 A | | 4/1935 | W. E. Musgrave | 120/38 |
| 2,069,462 A | | 2/1937 | J. H. Rouse | 120/38 |
| 2,205,929 A | | 6/1940 | J. R. Musgrave | 120/38 |
| 3,741,488 A | | 6/1973 | Maxwell | 401/17 |
| 3,765,780 A | | 10/1973 | Guu et al. | |
| 3,941,488 A | * | 3/1976 | Maxwell | 401/17 |
| D279,992 S | | 8/1985 | Gribb | D19/43 |
| 4,557,618 A | | 12/1985 | Iwata et al. | 401/34 |
| 4,594,362 A | | 6/1986 | Smith et al. | 521/52 |
| D295,878 S | | 5/1988 | Lovell | D19/43 |
| 4,755,074 A | | 7/1988 | Roberts | 401/52 |
| 4,815,881 A | * | 3/1989 | Chern | 401/52 |
| 4,979,254 A | | 12/1990 | Naujock | 15/3.53 |
| D314,843 S | | 2/1991 | Kamali | D28/91.1 |
| 5,015,111 A | | 5/1991 | Petterson | 401/52 |
| 5,072,483 A | | 8/1991 | Durand | 15/210 R |

(Continued)

FOREIGN PATENT DOCUMENTS

| | | | |
|---|---|---|---|
| GB | 595 461 | 12/1947 | |
| GB | 2 325 649 | * 12/1998 | B43K/29/02 |

OTHER PUBLICATIONS

International Search Report (counterpart PCT) Mar. 25, 2004.
Written Opinion (counterpart PCT) Mar. 25, 2004.

*Primary Examiner*—David J. Walczak
(74) *Attorney, Agent, or Firm*—Marshall & Gerstein & Borun LLP

(57) ABSTRACT

A writing assembly includes a writing instrument having a first end with a marking point depending therefrom and a second, opposite end, and a cap having a first end with a receptacle defined therein and a second end, the first end of the writing instrument disposed into the receptacle of the cap in a first, storage state and the second end of the writing instrument disposed into the receptacle of the cap in a second, operational state. The writing assembly also includes an eraser assembly including a carrier and an eraser material attached to the carrier, the carrier attached to the second end of the cap.

19 Claims, 3 Drawing Sheets

U.S. PATENT DOCUMENTS

| | | | | | |
|---|---|---|---|---|---|
| D330,388 | S | | 10/1992 | Choi | D19/36 |
| 5,338,123 | A | | 8/1994 | Obersteller et al. | 401/34 |
| D355,933 | S | | 2/1995 | Collins | D19/36 |
| 5,427,278 | A | | 6/1995 | Gardner, III | 222/129 |
| 5,451,114 | A | | 9/1995 | Ishigaki | 401/202 |
| 5,598,604 | A | | 2/1997 | Ho | 15/433 |
| 5,774,931 | A | | 7/1998 | Coinon et al. | 15/431 |
| D402,691 | S | | 12/1998 | Zbras, Jr. | D19/36 |
| 5,855,442 | A | * | 1/1999 | Keller | 401/195 |
| 5,871,294 | A | | 2/1999 | Turner | 401/52 |
| 5,890,830 | A | | 4/1999 | Ginelli | 401/198 |
| 5,895,160 | A | | 4/1999 | Ginelli | 401/17 |
| 5,897,265 | A | | 4/1999 | Wilson | 401/199 |
| 5,897,266 | A | * | 4/1999 | Robert | 401/202 |
| 5,947,624 | A | * | 9/1999 | Davignon | 401/202 |
| 5,957,603 | A | | 9/1999 | Bell | 401/52 |
| 5,988,914 | A | | 11/1999 | Kageyama et al. | 401/52 |
| D420,048 | S | | 2/2000 | Sims et al. | D19/53 |
| 6,019,535 | A | | 2/2000 | Turner | 401/52 |
| 6,048,121 | A | | 4/2000 | Carver | 401/52 |
| 6,056,468 | A | | 5/2000 | Niewiadomski | 401/195 |
| D445,130 | S | | 7/2001 | Ginelli | D19/36 |
| 6,309,129 | B1 | | 10/2001 | Kageyama et al. | 401/401 |
| D452,529 | S | | 12/2001 | Tsuchida | D19/66 |
| 6,347,898 | B1 | | 2/2002 | Rhodes et al. | 401/52 |
| D456,842 | S | | 5/2002 | Ono | D19/36 |

* cited by examiner

WRITING ASSEMBLY WITH ERASER ASSEMBLY

TECHNICAL FIELD

The disclosure is directed to a writing assembly, and in particular, to a writing assembly with an eraser assembly.

BACKGROUND

Dry erase markers may be used to mark on a dry erase marking board, which may also be referred to as a whiteboard, in a temporary fashion. That is, the ink used in such dry erase markers may be formulated to dry quickly on the surface of the marking board, and to be removable from the surface of the marking board by brushing the dried ink off using an object made with a material such as felt. The object may be shaped in the form of a brick, and thus may be similar in appearance to a traditional chalk eraser.

Alternatively, the material may be attached to a portion of the dry erase marker or to a holder for the dry erase marker. However, the ease of use such devices may present a problem, as the eraser material may be disposed for use with the marker only in one of a storage state and an operational state. Moreover, if the eraser material becomes saturated with dry erase ink, ink dust or other materials, continued use, disposal, and/or replacement of the eraser material may present problems.

DESCRIPTION OF THE EMBODIMENTS

Figure 1:
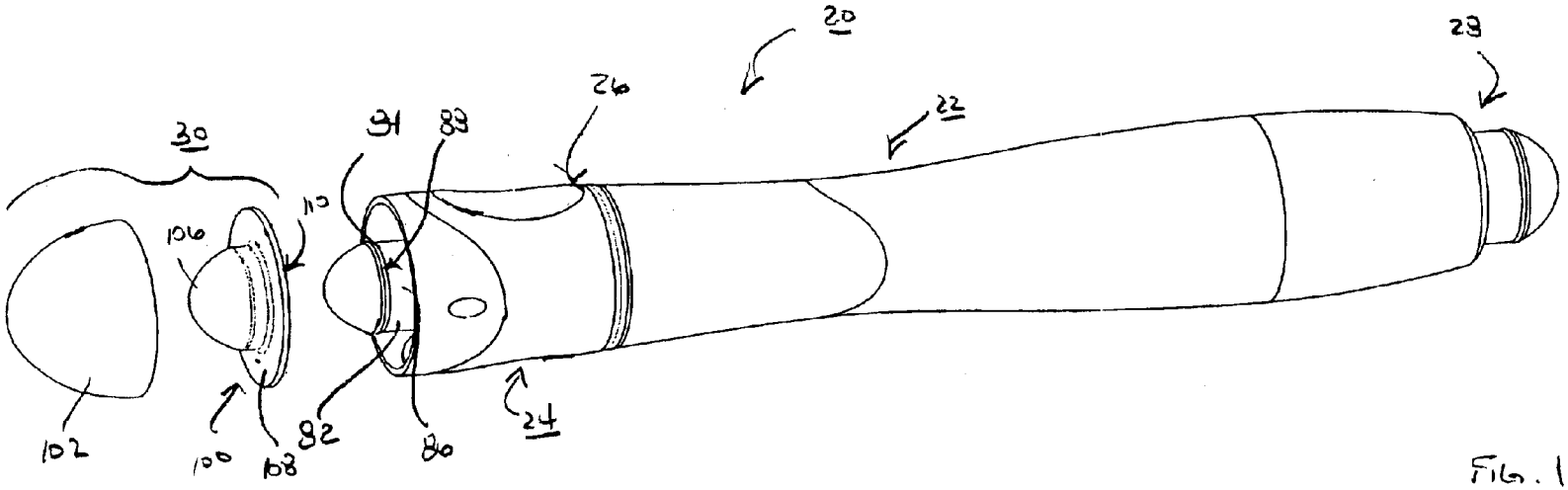
FIG. 1 is a partially exploded view of a first example of a writing assembly.
Figure 2:
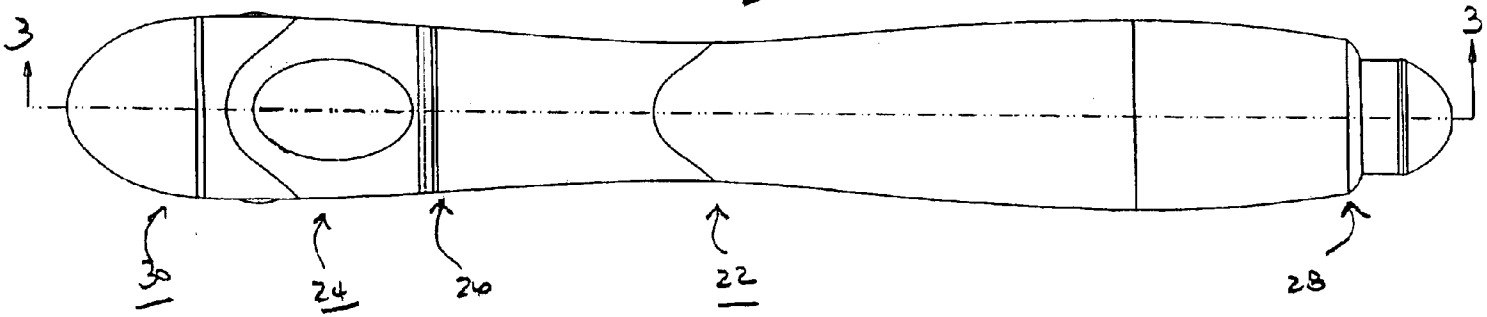
FIG. 2 is a plan view of the writing assembly of FIG. 1, assembled.
Figure 3:
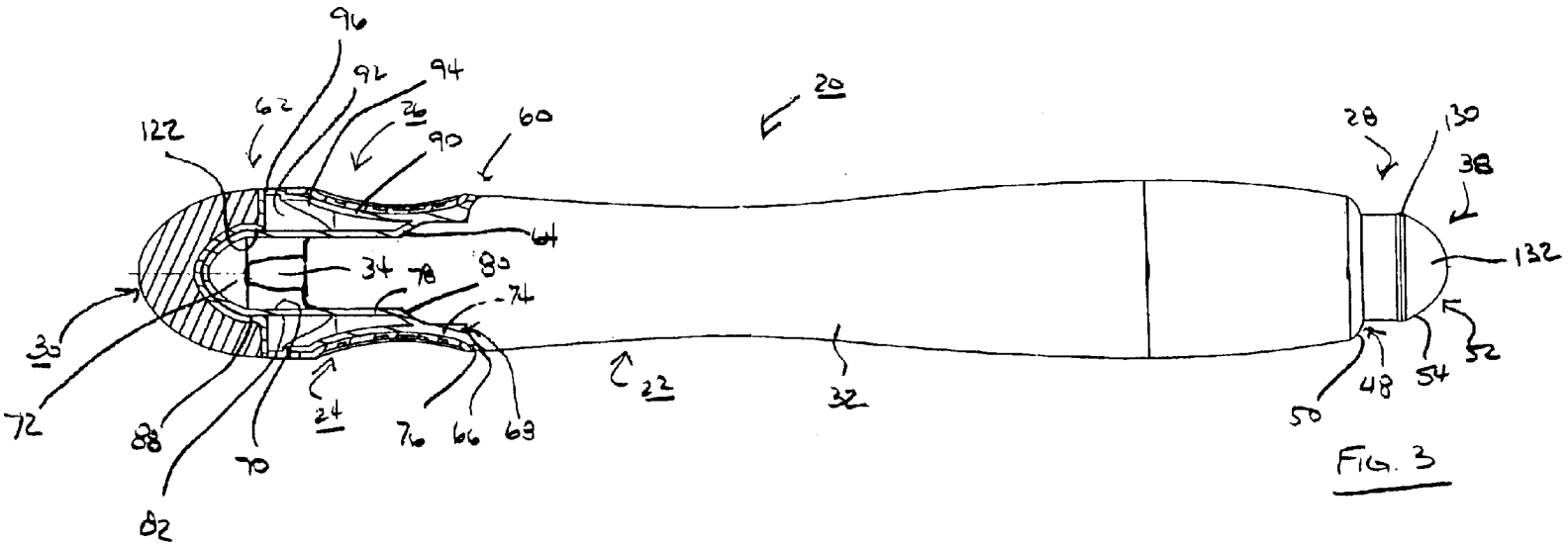
FIG. 3 is a cross-sectional view of the pen of FIG. 2 taken about line 3—3 in FIG. 2, with the cap in a first, storage state.
Figure 4:
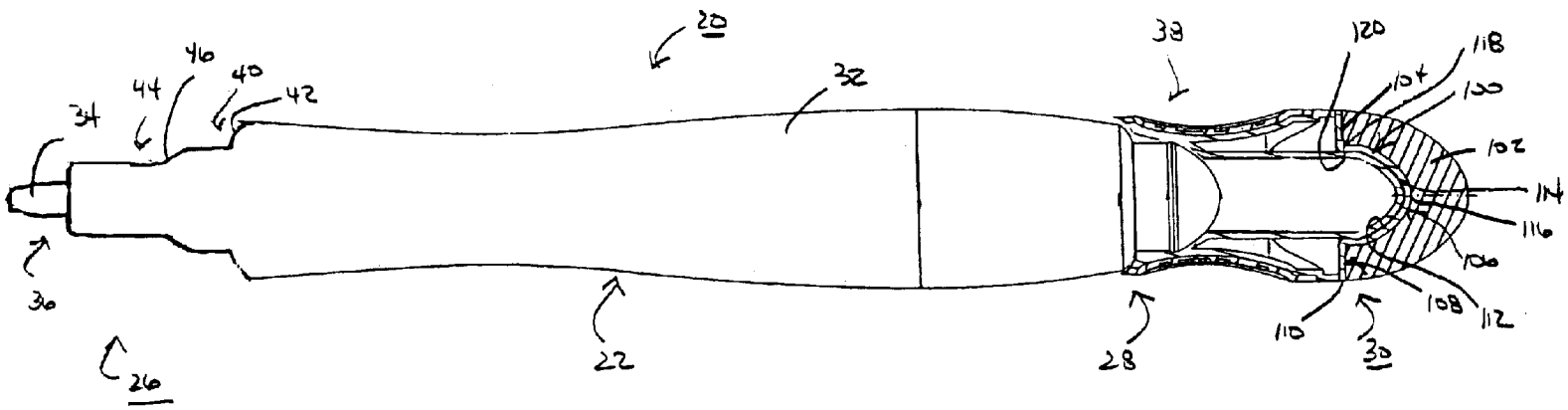
FIG. 4 is a cross-sectional view of the pen of FIG. 2 taken about line 3—3 in FIG. 2, with the cap in a second, operational state.

FIG. 1 shows an example of a writing assembly 20 which may include a writing instrument 22; in the instant case, the writing instrument 22 may be a dry-erase marker. The writing assembly 20 may also include a cap 24, which may be disposed on a first end 26 of the writing instrument 22, as shown in FIGS. 1, 2 and 3, or on the second end 28 of the writing instrument 22, as shown in FIG. 4. The writing assembly 20 may further include an eraser assembly 30, which is shown in exploded view in FIG. 1 and as assembled in FIGS. 2–4. While the eraser assembly 30 may be detachable or removable from the cap 24 as shown, the eraser assembly 30 may alternatively be fixedly attached or permanently attached to the cap 24.

Turning first to the writing instrument 22 and with reference to FIGS. 3 and 4, it will be recognized that the writing instrument 22 may include a body 32 and a writing point 34. The body 32 may have a first, open end 36 and a second, closed end 38. The writing point 34 may depend from the first, open end 36 of the body 32, and may be made from a fibrous material, such as felt, so as to provide a mechanism for conveying an ink, such as a dry-erase ink, from a reservoir (not shown) disposed within the body 32.

Both ends 36, 38 of the writing instrument 22 may be tapered and stepped. As seen best in FIG. 4, the first end 36 may have a first stepped region 40 defined by a shoulder 42 and a second stepped region 44 defined by a shoulder 46. Likewise, as best seen in FIG. 3, the second end 38 may have a first stepped region 48 defined by a shoulder 50 and second stepped region 52 defined by a shoulder 54. For reasons that will become apparent, the first stepped regions 40, 48 and second stepped regions 44, 52 may be similar in shape and curvature.

The cap 24 may have a first end 60 and a second end 62. A wall 64 may extend axially from the first end 60 to the second end 62. The wall 64 may have a rim 66 at the first end 60 that may define an opening 68. The wall 64, and in particular the inner surface 70 of the wall 64, may define a space or receptacle 72 therein that is in communication with the opening 68. The wall 64 may be closed at the second end 62 of the cap 24.

The wall 64, and in particular the inner surface 70 of the wall 64, may be stepped. As shown in FIG. 3, the inner surface 70 may have a first stepped region 74 defined by a shoulder 76 and a second stepped region 78 defined by a shoulder 80. The first stepped region 74 may be complementary to the first stepped regions 40, 48 of the first and second ends 36, 38 of the body 32, while the second stepped region 78 may be complementary to the second stepped regions 44, 52 of the first and second ends 36, 38 of the body 32.

The wall 64 of the cap 24 may also define a post 82. As shown, the post 82, like the receptacle 72, may extend from the first end 60 to the second end 62 of the cap 24. The post 82 may have an annular rib 84 (as best seen in FIG. 1) formed on an external surface 86 thereof nearest the second end 62 of the cap 24. The rib 84 may define an axially facing surface 88.

The cap 24 may also include a wall 90. The wall 90 may extend axially from the first end 60 toward the second end 62. The wall 90, however, may be disposed radially outward of the post 82. The wall 90 and the post 82, an in particular the outer surface 86 of the post 82, may define therebetween a space 92. Given the concentric arrangement of the post 82 and the wall 90, the space 92 defined therebetween may be an annular space. As shown, one or more ribs 94 may be disposed in the space 92 for purposes of reinforcing the wall 90.

The wall 90 may have an outer rim 96. Given the cylindrical geometries used in this example, the rim 96 may be a circular rim. As shown in FIGS. 1, 3 and 4, the post 82 may extend axially beyond the rim 96 of the wall 90 in the direction of the second end 62 of the cap 24. In particular, the rib 84 disposed on the post 82 may be disposed on the portion of the post 82 that extends axially beyond the rim 96 of the wall 90 in the direction of the second end 62 of the cap 24.

Returning now to FIG. 1, the eraser assembly 30 may include a hat-shaped carrier 100 and a hemispherical-shaped form of eraser material 102 attached thereto. The hat-shaped carrier 100 may include a wall 104 that may define a central boss 106 and a radially outwardly extending flange 108 that may terminate in a circular rim 110. As best seen in FIGS. 3 and 4, the portion of the wall 104 that defines the central boss 106 may have a surface 112 that may define a receptacle 114. The eraser material 102, which may be foam, felt, cloth or sponge, for example, may be disposed on a surface 116 of the wall 104 opposite the surface 112, and may be fixed thereto through the use of an adhesive material, for example.

The eraser assembly 30 may be selectively attached to the second end 62 of the cap 24 in the following manner. The post 82 may be disposed into the receptacle 114 of the carrier 100 of the assembly 30. As the post 82 is advanced into the receptacle 114, the rib 84 disposed on the outer surface 86 of the post 82 may be advanced past an edge 118 defining an opening 120 in communication with the receptacle 114. The edge 118 may also define an axially facing surface 122. The opening 120 may be smaller in effective diameter that the radially outermost portion of the rib 84, but not so much so that the post 82 is prevented from moving axially relative to the eraser assembly 30 while the eraser assembly 30 is being attached to the cap 24. However, once the rib 84 is advanced past the edge 118, the rib 84 and the edge 118 may cooperate to limit the relative axial movement between the cap 24 and the eraser assembly 30. In particular, as best seen in FIG. 3, the axially facing surfaces 88, 122 may abut to limit the movement between the cap 24 and the eraser assembly 30. The eraser assembly 30 may thus be attached to the cap 24, but may be detached if sufficient force is applied to the eraser assembly 30 to force the rib 84 past the edge 118. With the eraser assembly 30 and the cap 24 thus secured, the rim 96 of the wall 90 may abut the rim 110 of the flange 108 of the carrier 100.

As an alternative, the post 82 may not include a rib 84. Instead the external surface 86 of the post 82 may have a section of effective diameter that is larger that the effective diameter of the opening 120, but not so much so that the post 82 is prevented from moving axially relative to the eraser assembly 30 while the eraser assembly 30 is being attached to the cap 24. It will thus be recognized that the section of the outer surface 86 may define one of the axially facing surfaces of the cap 24 and the eraser assembly 30 that cooperate to limit the relative axial movement between the cap 24 and the eraser assembly 30.

In use, the cap 24 may be attached to the writing instrument 22 either at the first end 26 or the second end 28.

For example, to attach the cap 24 to the first end 26 of the writing instrument 22, the writing instrument 22 may be disposed axially into the receptacle 72 defined by the wall 64 of the cap 24, until the shoulders 42, 76 and 46, 80 abut. The stepped regions 40, 74 and 44, 78 may form an interference fit which limits the movement of the cap 24 relative to the first end 26 of the writing instrument 22. The stepped regions 40, 74 may be tapered in a complementary fashion to enhance the interference fit. In this state, the writing point 34 may be disposed into the receptacle 72 to prevent drying out of the writing point 34.

Similarly, the cap 24 may be attached to the second end 28 of the writing instrument 22 by disposing the second end 28 of the writing instrument 22 into the receptacle 72, until shoulders 50, 76 and 54, 80 abut. The stepped regions 48, 74 and 52, 78 may form an interference fit which limits the movement of the cap 24 relative to the second end 28 of the writing instrument 22. Moreover, a rib 130 may be disposed on an outer surface 132 of the second end 28 of the writing instrument 22 to cooperate with the inner surface 70 of the cap 24 to enhance the interference fit. In this state, the writing point 34 may be exposed to permit use of the writing point 34.

In either the storage state or the operational state, the eraser material 102 may be disposed in such a manner that it is fully exposed for use in removing ink that has been applied to a surface, such as the surface of a dry erase marking board (which may also be referred to as a whiteboard). Moreover, given the detachable nature of the eraser assembly 30 from the cap 24, when, for example, the eraser material 102 becomes saturated with ink or ink dust, the eraser assembly 30 may be removed from the cap 24, and may be replaced with a new eraser assembly 30.

Figure 5:
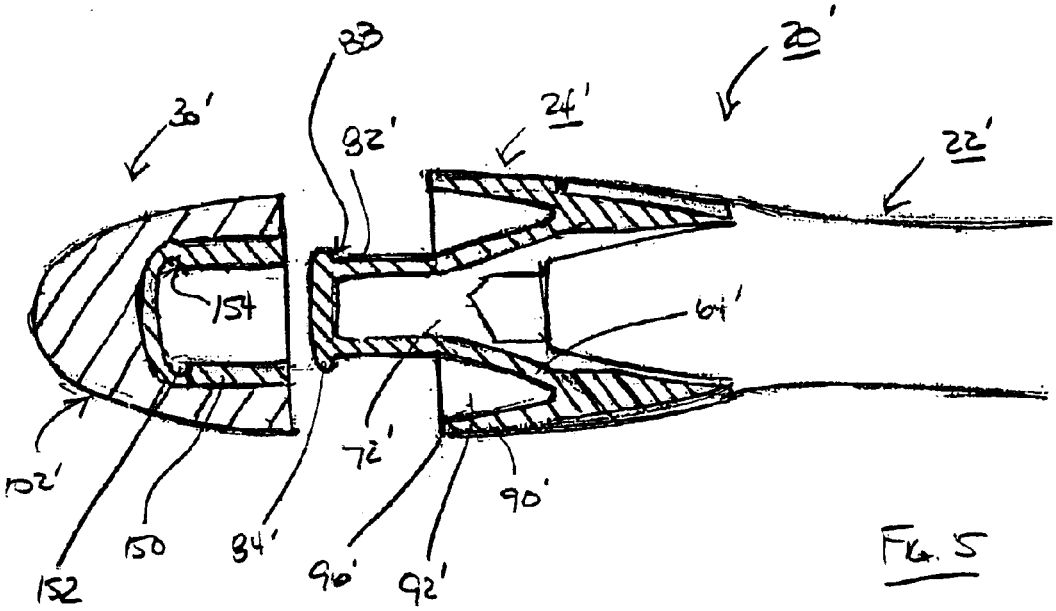
FIG. 5 is a partial cross-sectional view of a second example of a writing assembly.
Figure 6:
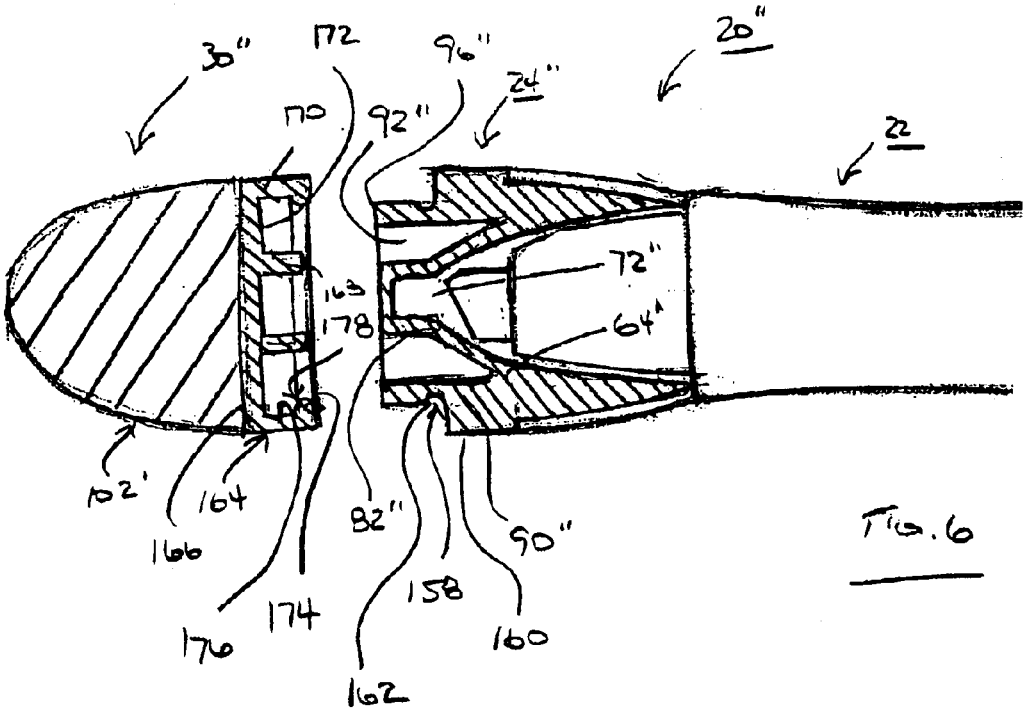
FIG. 6 is a partial cross-sectional view of a third example of a writing assembly.

It will be recognized that numerous modifications and alternatives may be purposed to the writing assembly 20 described above. In addition to those already mentioned, two further examples are provided in FIGS. 5 and 6. In the examples of FIGS. 5 and 6, elements in common with the example of the writing assembly 20 shown in FIGS. 1–4 are numbered similarly, but with a prime or double-prime to differentiate between the elements of the various examples.

In the example of FIG. 5, the writing assembly 20' may include a writing instrument 22' and a cap 24'. The cap 24' may be similar to the cap 24 in that the cap 24' may have a first wall 64' that may define a receptacle 72' and a post 82', and a second wall 90' that may be disposed radially outward from the post 82' so as to define a space 92' between the post 82' and the second wall 90'. The second wall 90' may have a rim 96', and the post 82' may extend beyond the rim 96' of the second wall 90' and may have an annular rib 84' formed thereon on the portion of the post 82' that may extend axially beyond the rim 96' of the second wall 90'. Moreover, the rib 84' may define an axially facing surface 88'.

The eraser assembly 30' of the example of FIG. 5 may include a carrier 150 and eraser material 102' attached to the carrier 150. The carrier 150 may be in the form of a cylinder into which the post 82' of the cap 24' may be disposed when the eraser assembly 30' is attached to the cap 24'. It will be noticed that in this example, the carrier 150 includes a groove 152, which is complementary to and in which the rib 84' of the post 82' is disposed to limit the movement of the eraser assembly 30' and the cap 24' relative to each other. In particular, the groove 152 may define an axially facing surface 154 that abuts the axially facing surface 88' to limit the movement of the eraser assembly 30' and the cap 24' relative to each other.

In the example of FIG. 6, like that of FIGS. 1–4 and 5, the writing assembly 20" may include a writing instrument 22" and a cap 24". The cap 24" may be similar to the cap 24 in that the cap 24" has a first wall 64" that may define a receptacle 72" and a post 82", and a second wall 90" may be disposed radially outward from the post 82" so as to form a space 92" between the post 82" and second wall 90". Further, the second wall 90" may have a rim 96". However, the post 82" may not extend beyond the rim 96" of the second wall 90". Moreover, the post 82" may not have an annular rib formed thereon; instead, an annular groove 158 may be formed in an outer surface 160 of the second wall 90". The groove 158 may define an axially facing surface 162.

The eraser assembly 30" of the example of FIG. 6 may include a carrier 164 and eraser material 102" attached to a first surface 166 of the carrier 164. First and second concentric annular walls 168, 170 may depend from a second surface 172 of the carrier 164 opposite the first surface 166 of the carrier 164. The effective diameter and central placement of the first annular wall 168 may be such that the end of the post 82" may be disposed within the first annular wall 168 with the eraser assembly 30" attached to the cap 24". The effective diameter and placement of the second annular wall 170 about a radial outermost edge of the carrier 164 may be such that the second wall 90" of the cap 24" may be disposed within the second annular wall 10 with the eraser assembly 30" attached to the cap 24". Further, the second annular wall 170 may have an annular rib 174 formed on a radially inwardly facing surface 176 of the second annular wall 170, and the rib 174 may be received within and cooperate with the annular groove 160 in the second wall 90" of the cap 24" to limit the axial movement of the eraser assembly 30" relative to the cap 24". In particular, the rib 174 may define an axially facing surface 178 that abuts the axially facing surface 162 to limit the movement of the eraser assembly 30" and the cap 24" relative to each other.

Other modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

We claim:

1. A writing assembly comprising:

a writing instrument having a first end with a marking point depending therefrom and a second, opposite end;

a cap having a first end with a receptacle defined therein and a second end, the first end of the writing instrument disposed into the receptacle of the cap in a first, storage state and the second end of the writing instrument disposed into the receptacle of the cap in a second, operational state; and an eraser assembly separate from the cap and including a carrier and an eraser material attached to the carrier, the carrier attached to the second end of the cap, the cap and the carrier each having one of a pair of axially facing surfaces formed thereon, the axially facing surface on the cap abutting the axially facing surface on the carrier with the eraser assembly attached to the cap and the axially facing surface of the cap disposed further axially from the first end of the cap than the axially facing surface of the carrier.

2. The writing assembly according to claim 1, wherein:

the cap has a post with a rib formed thereon, the rib defining the axially facing surface formed on the cap; and the carrier has an edge that defines an opening, the edge defining the axially facing surface formed on the cap, at least the part of the post with the rib formed thereon disposed through the opening in the carrier with the eraser assembly attached to cap, the axially facing surfaces defined by the rib and the edge abutting to limit the movement of the eraser assembly and the cap relative to each other.

3. The writing assembly according to claim 1, wherein:

one of the cap and the carrier has a groove that defines one of the pair of axially facing surfaces and the other of the cap and the carrier has a rib that defines the other of the pair of axially facing surfaces;

the rib disposed within the groove with the eraser assembly attached to the cap, the axially facing surfaces defined by the rib and the groove abutting to limit the movement of the eraser assembly and the cap relative to each other.

4. The writing assembly according to claim 3, wherein:

the cap has a post depending from the second end of the cap, the post having a surface on which the rib is formed; and the carrier has wall with an inner surface that defines a receptacle and has a groove formed therein, the post disposed within the receptacle and the rib disposed within the groove with the carrier attached to the cap.

5. The writing assembly according to claim 3, wherein:

the cap has an annular wall depending from the first end of the cap toward the second end of the cap and having an effective diameter and a radially exterior surface in which the groove is formed; and the carrier has an annular wall having an effective diameter greater than the effective diameter of the cap and a radially inwardly facing surface on which the rib is formed, the annular wall of the cap disposed within the annular wall of the carrier and the rib of the carrier disposed within the groove of the cap with the carrier attached to the cap.

6. The writing assembly according to claim 1, wherein:

the cap comprises a post depending from the second end of the cap; and the carrier has an opening formed therein, the post being received through the opening with the carrier attached to the second end of the cap.

7. The writing assembly according to claim 6, wherein:

the post has a rib formed on an outer surface thereof; and the carrier having an edge defining the opening, the rib and the edge abutting with the eraser assembly attached to the second end of the cap to limit the movement of the eraser assembly and the cap relative to each other.

8. The writing assembly according to claim 7, wherein:

the carrier has a wall with a central boss and a flange that depends radially outwardly from the central boss, the boss having an open end defined by the opening and a closed end opposite the open end, the carrier having an edge formed about the opening that defines the opening; and the rib of the post and the edge of the carrier abutting to limit the movement of the eraser assembly and the cap relative to each other.

9. The writing assembly according to claim 8, wherein:

the carrier has first and second opposing sides, the opening defined in the first side of the carrier and the eraser material disposed on the second side of the carrier.

10. The writing assembly according to claim 1, wherein the eraser material is selected from the group of eraser materials consisting of foam, felt, cloth, and sponge.

11. The writing assembly according to claim 1, wherein the writing instrument is a dry erase marker.

12. A writing assembly comprising:

a writing instrument having a first end with a marking point depending therefrom and a second, opposite end;

a cap having a first end with a receptacle defined therein and a second end, the first end of the writing instrument disposed into the receptacle of the cap in a first, storage state and the second end of the writing instrument disposed into the receptacle of the cap in a second, operational state; and an eraser assembly including a carrier and an eraser material attached to the carrier, the carrier attached to the second end of the cap, the cap and the carrier each have one of a pair of axially facing surfaces formed thereon, the axially facing surface on the cap abutting the axially facing surface on the carrier with the eraser assembly attached to the cap and the axially facing surface of the cap disposed further axially from the first end of the cap than the axially facing surface of the carrier.

13. The writing assembly according to claim 12, wherein:

the cap has a post with a rib formed thereon, the rib defining the axially facing surface formed on the cap; and the carrier has an edge that defines an opening, the edge defining the axially facing surface formed on the carrier, at least the part of the post with the rib formed thereon disposed through the opening in the carrier with the eraser assembly attached to cap, the axially facing surfaces defined by the rib and the edge abutting to limit the movement of the eraser assembly and the cap relative to each other.

14. The writing assembly according to claim 12, wherein:

one of the cap and the carrier has a groove that defines one of the pair of axially facing surfaces and the other of the cap and the carrier has a rib that defines the other of the pair of axially facing surfaces;

the rib disposed within the groove with the eraser assembly attached to the cap, the axially facing surfaces defined by the rib and the groove abutting to limit the movement of the eraser assembly and the cap relative to each other.

15. The writing assembly according to claim 14, wherein:

the cap has a post depending from the second end of the cap, the post having a surface on which the rib is formed; and the carrier has wall with an inner surface that defines a receptacle and has a groove formed therein, the post disposed within the receptacle and the rib disposed within the groove with the carrier attached to the cap.

16. The writing assembly according to claim 14, wherein:

the cap has an annular wall depending from the first end of the cap toward the second end of the cap and having an effective diameter and a radially exterior surface in which the groove is formed; and the carrier has an annular wall having an effective diameter greater than the effective diameter of the cap and a radially inwardly facing surface on which the rib is formed, the annular wall of the cap disposed within the annular wall of the carrier and the rib of the carrier disposed within the groove of the cap with the carrier attached to the cap.

17. A writing assembly comprising:

a dry erase marker having a first, open end with a marking point depending therefrom and a second, opposite, closed end;

a cap having a first end with a receptacle defined therein and a second end with a post depending therefrom with a rib formed thereon, the first end of the writing instrument disposed into the receptacle of the cap in a first, storage state and the second end of the writing instrument disposed into the receptacle of the cap in a second, operational state; and an eraser assembly including a carrier and an eraser material attached to the carrier, the carrier having a wall with a central opening defined by an edge and a flange that depends radially outwardly from the central opening, the eraser assembly attached to the cap with the post of the cap disposed through the opening in the carrier and the rib of the post and the edge of the carrier abutting to limit the movement of the eraser assembly and the cap relative to each other.

18. The writing assembly according to claim 17, wherein:

the carrier has first and second opposing sides, the first side of the carrier facing the cap and the eraser material disposed on the second side of the carrier.

19. The writing assembly according to claim 17, wherein the eraser material is selected from the group of eraser materials consisting of foam, felt, cloth, and sponge.

* * * * *